US006158464A

United States Patent [19]

Campbell et al.

[11] Patent Number: 6,158,464

[45] Date of Patent: Dec. 12, 2000

[54] LOW PRESSURE BACK-UP VALVE FOR POOL CLEANER

[75] Inventors: Sanford F. Campbell, Redding; Daniel D. Caris, Shasta Lake City, both of Calif.

[73] Assignee: Letro Products, Inc., Redding, Calif.

[21] Appl. No.: 09/200,369

[22] Filed: Nov. 23, 1998

[51] Int. Cl.[7] ..... F16K 51/00

[52] U.S. Cl. ..... 137/624.11; 251/118; 137/624.14; 15/1.7

[58] Field of Search ..... 137/624.14, 624.11, 137/624.13, 883; 251/118, 123; 15/1.7

[56] References Cited

U.S. PATENT DOCUMENTS

| | | | |
|---|---|---|---|
| 2,694,545 | 11/1954 | Steenbergh | 251/118 X |
| 2,814,307 | 11/1957 | Hafele et al. | 251/118 X |
| 5,737,791 | 4/1998 | Durigon | 137/624.14 X |

*Primary Examiner*—Kevin Lee
*Attorney, Agent, or Firm*—Fliesler, Dubb, Meyer & Lovejoy LLP

[57] ABSTRACT

A backup valve for use with a pool cleaner coupled to a source of water under pressure, comprising: a housing having an inlet and at least one outlet; and a pressure inducing apparatus in the inlet to direct the flow of water into the housing at a greater pressure than that supplied by the water supply.

15 Claims, 5 Drawing Sheets

LOW PRESSURE BACK-UP VALVE FOR POOL CLEANER

BACKGROUND OF THE INVENTION

1. Field of the Invention

This invention relates generally to the field of automatic swimming pool cleaners, and more particularly, to reverse fluid flow valves for use with fluid supply lines connected to pool cleaners.

2. Description of the Related Art

A swimming pool normally includes a water filtration system for removing dirt and debris from the pool water. Such filtration systems typically include a circulation pump which is installed outside the swimming pool and a piping system for coupling the circulation pump to the swimming pool. The circulation pump draws water from the swimming pool for delivery through the piping system to a filter unit.

A conventional water filtration system is not designed to remove silt and debris which tends to settle irrespective of size onto the floor and sidewalls of a swimming pool.

To address the foregoing problems, automatic swimming pool cleaners for cleaning the floor and sidewalls of a swimming pool are well known. There are generally four types of pool cleaners in the pool cleaning market: pressure or return side cleaners; suction cleaners; electric cleaners and in-floor cleaners.

Generally, "pressure" or return-side cleaners perform superior cleaning over the other three types of cleaners. Pressure-type cleaners use pressurized water from a pump into the cleaner to sweep and collect debris into a bag carried by the cleaner.

Pressurized cleaners can be characterized into at least two categories - those requiring a booster pump and those which do not. Booster pumps are used in conjunction with the pools skimmer pump to provide pressurized water to the cleaner at a rate sufficient to operate the cleaner effectively.

One particular type of known automatic pressure cleaner is shown and described in co-pending U.S. patent application Ser. No. 09/108,283, fully incorporated herein by reference. Prior art cleaners were designed to be used with and required a booster pump be installed in order to generate sufficient pressure to the apparatus to power the device about the pool. In older pool installations, the pool's cleaning system may require retrofitting to install the booster pumps in order to properly operate the device. The apparatus described in the application Ser. No. 09/108,283 patent does not require a booster pump; rather, it is designed to operate using the lower fluid pressure of the pool's water existing filtration pump.

This type of cleaner (as well as other types of cleaners) operates on pressurized water that is supplied to the cleaner through a supply hose. The water is used in part to drive the blades of a turbine which, in turn, rotates two or more of the wheels, and in part to induce a flow of pool water upwardly through the cleaner suction mast and into the collection bag.

The drive wheels and a thrust jet propel the cleaner along the floor and sidewalls of the swimming pool. When the pool cleaner reaches an obstruction preventing further direct forward travel, the drive wheels impart a turning movement, causing the cleaner to turn and continue travel in a different direction. Alternatively, when the cleaner travels along the pool floor and reaches a smoothly curved region merging with a sidewall, the cleaner tends to travel through the curved region and crawl at least part way up the pool sidewall until the cleaner falls by gravity back to the floor of the pool. A ballast float mounted at the upper rear of the cleaner helps assure that the cleaner will land upright on the pool floor and resume travel in a forward direction.

In general, back-up valves provide additional insurance that a cleaner will not get stuck in edges or corners of pools by forcing a reversal of direction of the cleaner at regular intervals.

Construction of backup valves is well known. In particular, one such valve includes a housing containing a fly wheel, rotating cover plate, and gearing. The housing has a water inlet, and at least two water outlets directed generally toward the opposite end of the hosing from the inlet. One outlet is coupled by the supply line to the cleaner, while the other allows water to enter the pool directly, in a direction generally parallel to the supply line and the first outlet. Water is also prevented from entering the cleaner, thereby freeing backward movement of the cleaner. Water in the supply line enters the housing and drives the impeller to rotate the rotating cover plate to cover the fist outlet and redirect water in the housing to the second outlet for a period of time determined by the gearing. The rotation of the gearing and the rotating cover plate determines the amount of time that water is allowed to flow to the cleaner, and the amount of time water flows into the pool to "back-up" the cleaner.

With low pressure cleaners, that is, cleaners operating without the benefit of an additional booster pump, a difficulty has been found in obtaining the desired timing in backup valves due to the lower pressure of the water entering the inlet of the valve. Specifically, there is not enough pressure from the main water pressure source—without a booster pump—to accurately and regularly drive the impeller in the valve to ensure a constant spin rate and in some cases, not enough to even turn the wheel.

Generally back-up valves are used with pressure cleaners to ensure that the cleaner will not become otherwise jammed or stuck. The reverse valves contain a timing mechanism, such as a impeller and gears, which operate to direct the flow of water in the supply line out of the valve for some period of time in order to create tension on the line and dislodge any stuck cleaner.

SUMMARY OF THE INVENTION

Briefly, and in general terms, the present invention comprises a backup valve for use with a pool cleaner coupled to a source of water under pressure, comprising: a housing having an inlet and at least one outlet; and a pressure inducing apparatus in the inlet to direct the flow of water into the housing at a greater pressure than that supplied by the water supply without reducing the volume of water through the valve.

BRIEF DESCRIPTION OF THE DRAWINGS

The invention will be described with respect to the particular embodiments thereof. Other objects, features, and advantages of the invention will become apparent with reference to the specification and drawings in which.

DETAILED DESCRIPTION OF THE PREFERRED EMBODIMENTS

In many applications, it is desirable to utilize automatic cleaners with an existing pool installation where a booster pump is not installed. Normally, the pool cleaning system is fitted with a skimmer which operates a skimmer pump. The skimmer pump may be utilized with the automatic pool cleaner of co-pending application Ser. No. 09/108,283 to power the cleaner about the pool. In order to accomplish this, the cleaner must be able to operate without placing a strain on the skimmer pump or requiring the skimmer pump to generate additional pressure. To meet this need, the cleaner must be able to pass about the same volume of water per unit time which it receives from the pump.

Figure 1:
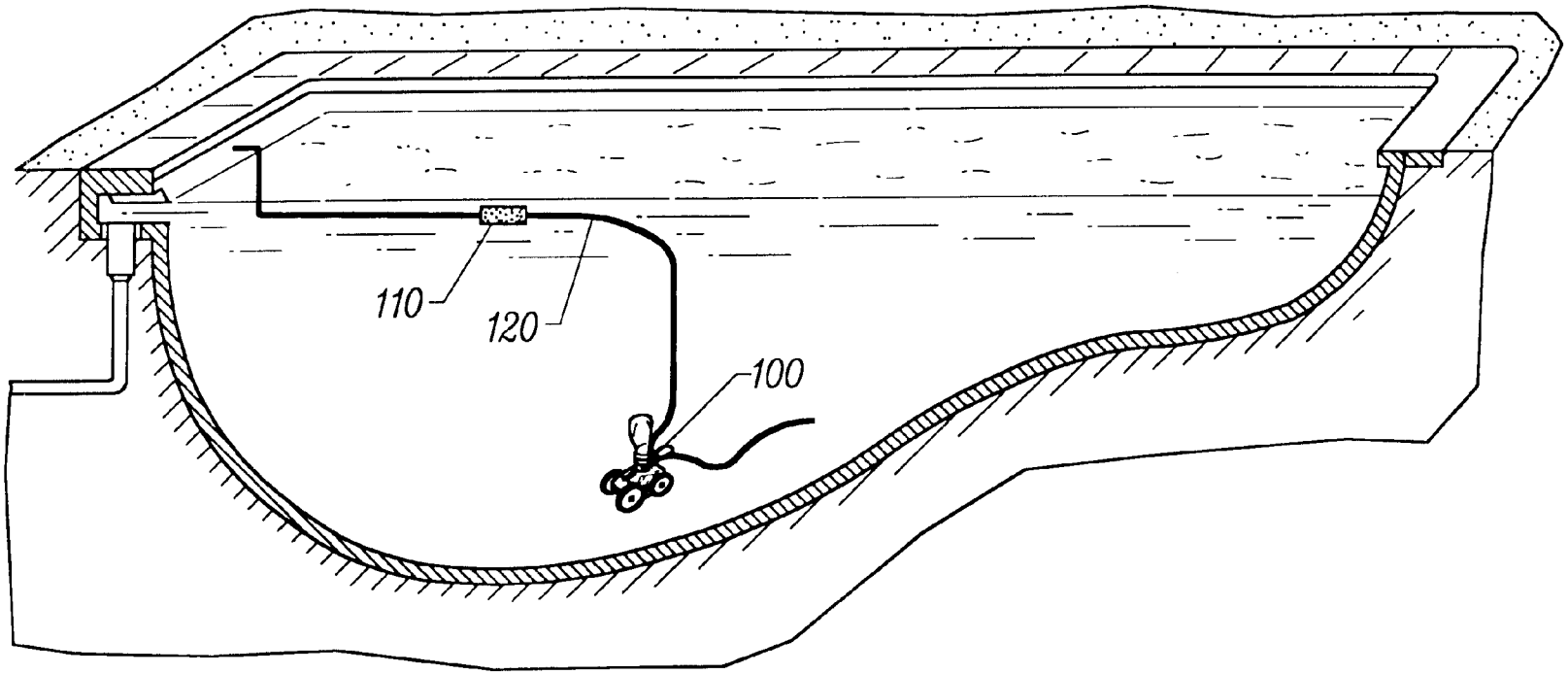
FIG. 1 is a perspective view of a pool cleaner in a pool
Figure 2:
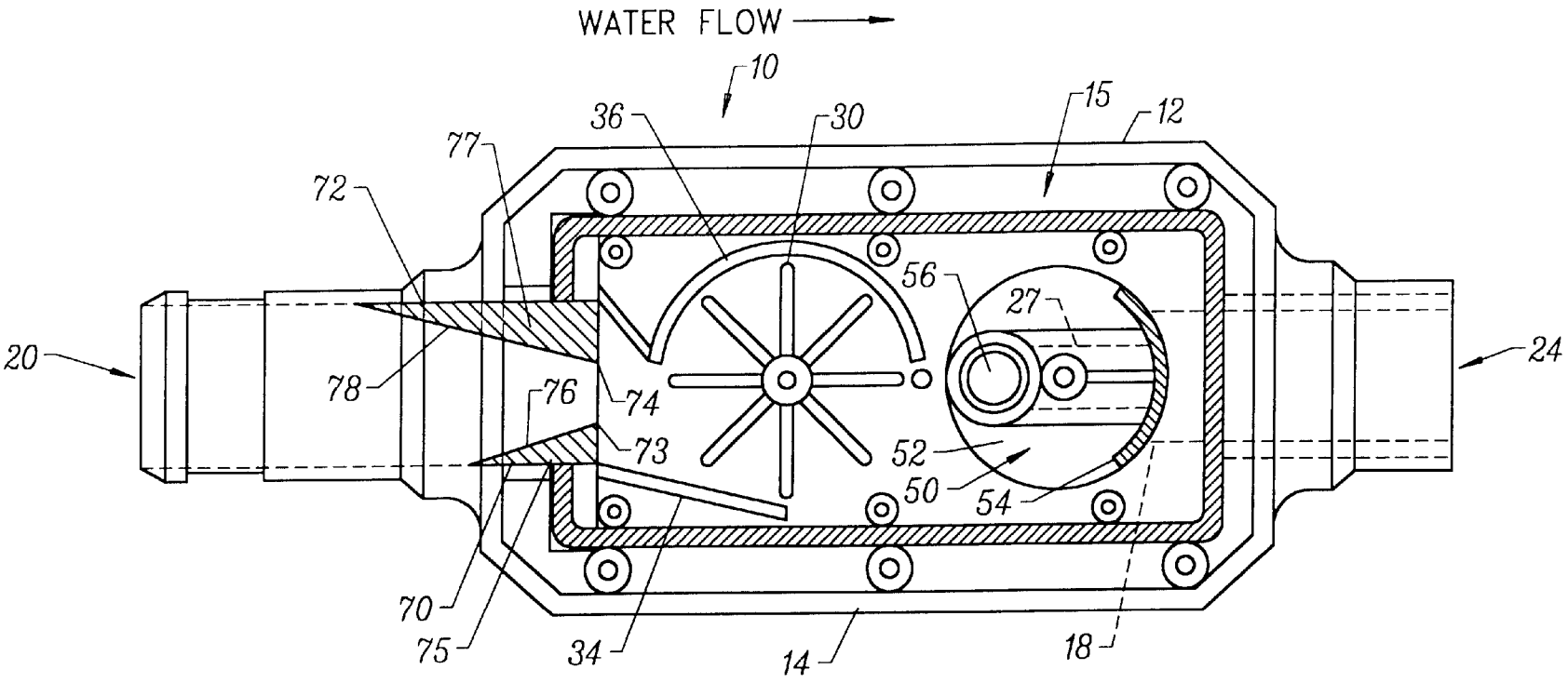
FIG. 2 is a top, partial cutaway view of a back-up valve in accordance with the present invention.

In some applications of the automatic pool cleaner specified in application Ser. No. 09/108,283, a back-up valve 110 may be provided on supply line 120 as shown in FIG. 1. The back-up valve redirects water entering the cleaner and literally pulls the cleaner in a backwards direction by forcing water out of the valve, reversing tension on the water supply line and pulling the cleaner backwards. After a predetermined volume of water passes through the supply line 120, the back-up valve diverts the flow of water external to the cleaner, and hence reverses the direction of the suction cleaner 100.

In accordance with the present invention, an improved, low pressure back-up valve 10 is disclosed. In particular, the backup valve of the present invention includes means to increase the pressure of the water entering the inlet as the water impacts the impeller in the housing.

Referring to FIGS. 2–5, the backup valve 10 in accordance with the present invention is shown therein. The valve 10 includes a housing 12 having a first inlet 20, and first 24 and second 26 outlets. The inlet 20 is coupled to a water supply hose 120 which is itself coupled to a water supply source (not shown), such as a skimmer pump. Inlet 20 and outlets 24 and 26 are generally cylindrical, are formed as part of a lower housing 14, which is sealably attached to a housing cover 16 to complete housing 12. Housing 12 may be pressure molded of plastic or other suitable material.

Mounted in housing 12 are a timing mechanism comprising an impeller 30, and gears 40, and a rotating diverter valve structure 50. Impeller 30 is rotatably mounted on a shaft 32 in lower housing 14. At a first end of shaft 32, a gear 34 couples shaft 32 to gears 50, and specifically gear 52. Gears 50 comprise individual gears 52–57. Gears 52, 53, and 54 are mounted on axis 60 while gears 55, 56, and 57 are mounted on axis 62. Each gear 52–57 includes a large sprocket engaging a smaller sprocket of the next vertically arranged gear. All gears 52–57 are secured to either axes 60,62, respectively, by a clamp 64. Gears 52–56 are free to rotate about the axes, while gear 57 is attached to axis 62 to drive rotation of the valve structure 50.

Diverter valve structure 50 includes a washer plate 52 and a semi-cylindrical valve door 54 which engages a semi-cylindrical portion 18 of housing 12 to prevent water flow thought first outlet 24. Plate 52 includes a bore 56 which opens inner chamber 15 of housing 12 to channel 27, leading to outlet 26.

Walls 34, 36 generally surround impeller 30 in order to direct water around impeller 30 to rotate impeller 30 on axis 32.

In prior art devices, the channel leading to inlet 20 has a cylindrical opening generally having a circular cross section to allow the pressurized water entering the backup valve 10 to flow freely to impeller 30.

However, in pool cleaning systems where no pressure pump is available, it has been found that the flow of water to the impeller results in inconsistent turning of the wheel and hence inconsistent timing of the backup flow of water from second outlet 26. In accordance with the present invention, a pressure inducer is provided to increase the water pressure at the impeller. In one embodiment, the pressure inducer comprises pressure inducing ramps 70,72.

Figure 3:
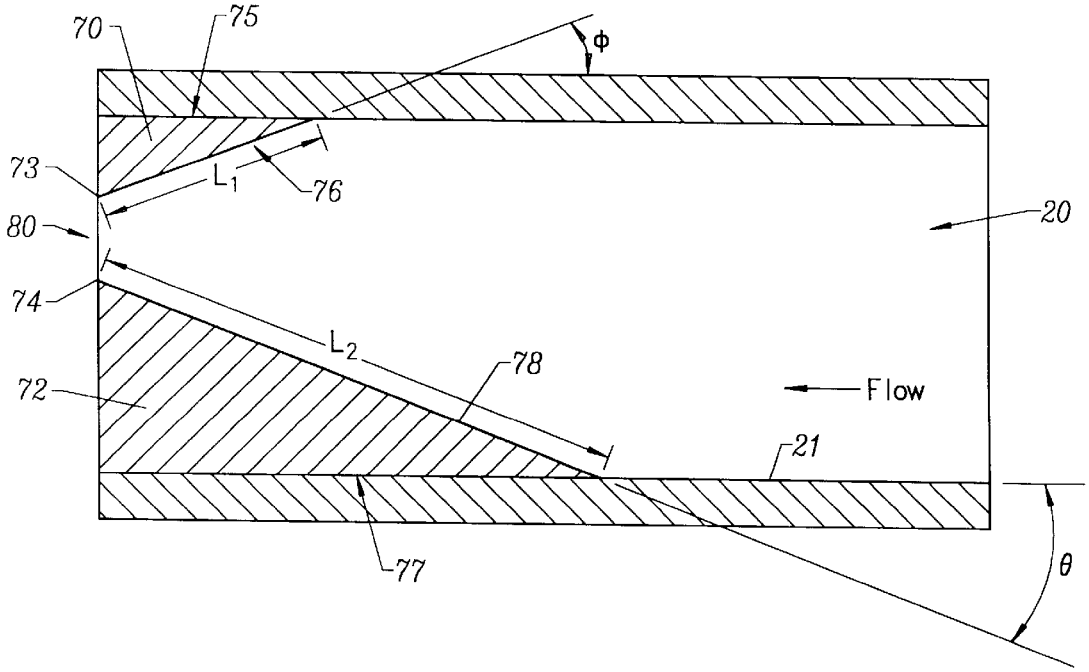
FIG. 3 is a partial, enlarged cross-section of the inlet shown in FIG. 2.
Figure 4:
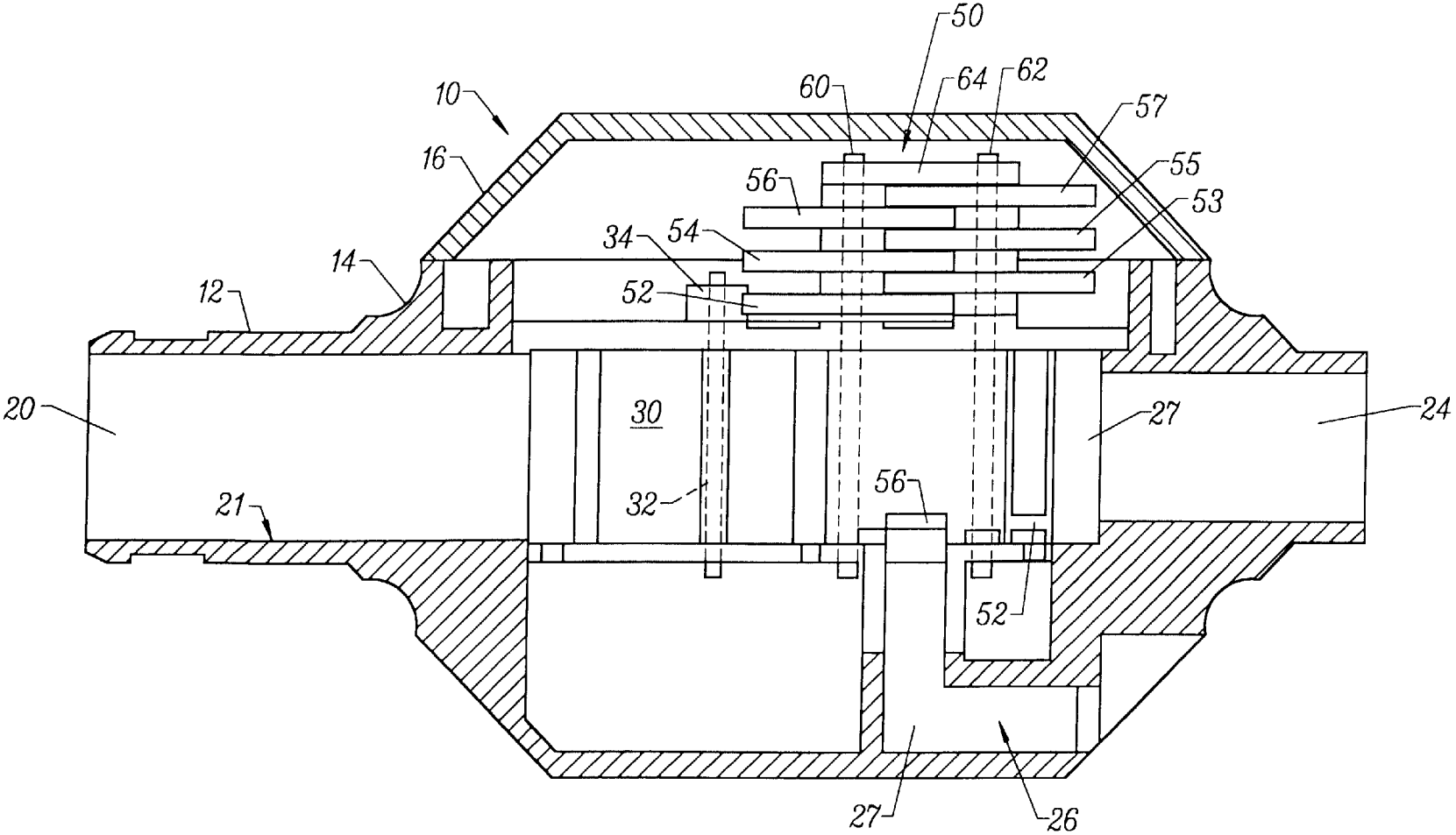
FIG. 4 is an exposed side view of the back-up valve shown in FIG. 2.

Ramps 70,72 compress the water flow, increasing the pressure and consistency of the flow to the impeller without reducing the volume of water through valve 10, resulting in a valve 10 which provides consistent timing for the redirection and backup operation. Notably, ramps 70, 72 are of different lengths, as shown in FIG. 3. Ramp 70, the shorter of the two ramps, has a triangular cross section as viewed from the top view of FIG. 3. Ramp 70 has a flat upper surface 76 and a semi-cylindrical back side 75 which allows ramp 70 to fit securely against the inner wall of inlet 70. Likewise, ramp 72, the longer of the two ramps, has a flat upper surface 78 and a semi-cylindrical back side 77, which allows it to fit securely in a directly opposing relationship to ramp 70. Surfaces 76 and 77 terminate in edges 73 and 74 to form a slit 80 through which water entering inlet 20 is compressed when it enters inner chamber 15 of valve 10.

Figure 5:
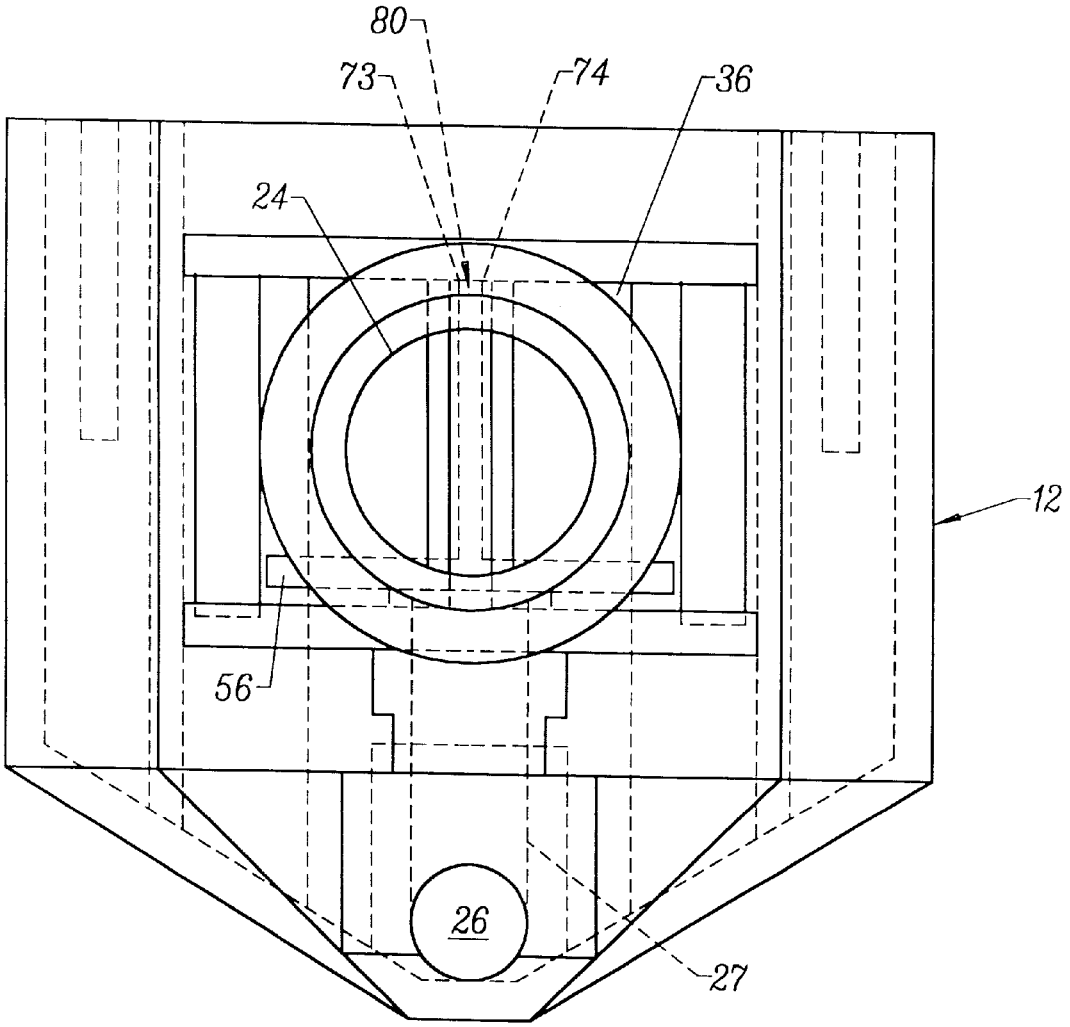
FIG. 5 is an end view of the back-up valve along arrow 5—5 in FIG. 4.

It has been empirically determined that using ramps of differing lengths effectuates the flow of water at a sufficient pressure on the valve without reducing water volume. The inlet structure of the valve of the present invention increases the pressure of water at a focal point in the interior 15 of valve 10, which is designed to be positioned adjacent to the outer diameter of impeller 30. As seen in FIG. 5, the first ramp 72 forms a triangle in cross-section such that surface 78 is the hypotenuse of the triangle. Surface 78 has a length (L1) which is about 1.75–2.5 times as long as the length (L2) of the surface 76 of the second ramp 70. In one embodiment, the ratio of length L1/L2 is about 2.1:1. It should be noted that the ratio may change relative to the size of the inlet 20, the linear distance between the end of the inlet (at slit 80) and the impeller, the size of valve 10, and the pressure of the skimmer pump supplied water.

In operation, the velocity of fluid increases significantly at the point of constriction, allowing the impeller to rotate faster, decreasing cycle times and maintaining consistency. The velocity is increased without reducing the volume of fluid through the valve.

While ramps of differing angles (with respect to the inner walls 21 of inlet 20) may be used, it has been found that the angles $\theta$ and $\phi$ formed between the inner wall opposite each ramp and the ramp are about 20°. It should be recognized that the angles of the respective ramps may differ, and an angle of 20° is exemplary only and may vary over a range between 1°–45°, depending on the size of the valve. The angle will, for example, change with the lengths L1 and L2. The primary objective is to arrange the ramps such that the focal point of the directed flow is located at the impeller.

Based on the foregoing, it will be appreciated that an improved swimming pool cleaner has been shown and described that has enhanced ability to function in low pressure supply environments. The cleaner has a highly reliable drive train which is substantially encased within the cleaner housing such that the drive train has virtually no exposure to potential jamming or damage from debris. It will further be appreciated that there maybe many configurations for a swimming pool cleaner in which the principles of the present invention are applicable. Therefore, the scope of the present invention should not be seen as limited except by the following claims.

What is claimed is:

1. A backup valve for use with a pool cleaner coupled to a source of water under pressure, comprising:

a housing having an inlet and at least a first outlet and a second outlet;

a pressure inducing apparatus in the inlet to direct the flow of water into the housing at a greater pressure than that supplied by the water supply; and a timing apparatus directing water from said inlet to the first outlet or the second outlet.

2. The valve of claim 1 wherein the timing apparatus comprises:

an impeller positioned adjacent to the inlet and timing gearing, and a deflector valve coupled to the timing gearing.

3. The valve of claim 2 wherein the pressure inducing apparatus comprises a first and second ramps positioned in the inlet.

4. The valve of claim 3 wherein the first ramp has a first surface having a first length and the second ramp has a first surface having a second length, different than the first length.

5. The valve of claim 4 wherein the ratio between the first length and the second length is in a range of 1.75 to 2.5.

6. The valve of claim 4 wherein the ratio between the first length and the second length is 2.1.

7. A backup valve for use with a pool cleaner coupled to a source of water under a pressure, comprising:

a housing having at least a first inlet and at least a first and a second outlets;

a timing apparatus in the housing directing water flow from the first inlet to the first outlet or the second outlet dependent upon the water flow to the inlet; and first and second ramps mounted in the inlet.

8. The valve of claim 7 wherein the timing apparatus comprises:

an impeller positioned adjacent to the inlet and timing gearing, and a deflector valve coupled to the timing gearing.

9. The valve of claim 7 wherein the first ramp has a surface having a first length and the second ramp has a surface having a second length, different than the first length.

10. The valve of claim 9 wherein the ratio between the first length and the second length is in a range of about 1.75–2.5.

11. A fluid flow direction valve, comprising:

a housing having an inlet coupled to a fluid supply, a first outlet and a second outlet;

a valve structure positioned in the housing and directing fluid to the first or second outlet responsive to fluid entering the inlet; and a pressure inducer, mounted in the inlet to direct the flow of fluid into the housing at a greater pressure than that supplied by the fluid.

12. The valve of claim 12 wherein the valve further includes:

an impeller positioned adjacent to the inlet and timing gearing, coupled to the valve structure.

13. The valve of claim 11 wherein the pressure inducer apparatus comprises a first and second ramps positioned in the inlet.

14. The valve of claim 13 wherein the first ramp has a surface having a first length and the second ramp has a surface having a second length, different than the first length.

15. The valve of claim 14 wherein the ratio between the first length and the second length is in a range of about 1.75–2.5.

* * * * *